US005423155A

United States Patent [19]

Bauer

[11] Patent Number: 5,423,155

[45] Date of Patent: Jun. 13, 1995

[54] PANEL FOR RESURFACING SLAT WALLS

[75] Inventor: Jeffrey R. Bauer, Cleveland, Ohio

[73] Assignee: Darko Company, Inc., Twinsburg, Ohio

[21] Appl. No.: 70,544

[22] Filed: Jun. 2, 1993

[51] Int. Cl.[6] ..... E04B 1/38

[52] U.S. Cl. ..... 52/506.01; 52/510; 40/618

[58] Field of Search ..... 52/506, 510, 536, 36, 52/78, 385; 40/618, 620

[56] References Cited

U.S. PATENT DOCUMENTS 5,052,137 10/1991 Edwards ..... 40/618
5,121,578 6/1992 Holz ..... 52/506

FOREIGN PATENT DOCUMENTS 5052015 3/1993 Japan ..... 52/506

*Primary Examiner*—Carl D. Friedman
*Assistant Examiner*—Creighton Smith
*Attorney, Agent, or Firm*—Renner, Kenner, Greive, Bobak, Taylor & Weber

[57] ABSTRACT

A panel (10) for covering a slat board (12) of a slat wall (11) includes a face portion (22) having a hook member (23) at its lower end and another hook member (24) at its upper end. The hook members (23, 24) are adapted to engage the lateral edges of the slat board (12) so that the face portion (22) is adjacent to the slat board (12). In another embodiment, opposed upper and lower tabs (29, 30) can be provided at the ends of face portion (22) so that graphic material may be held therebetween.

15 Claims, 4 Drawing Sheets

PANEL FOR RESURFACING SLAT WALLS

TECHNICAL FIELD

This invention relates to a panel-like strip of material utilized to resurface conventional slat wall structures. More particularly, this invention relates to such a material which not only covers damaged slat wall surfaces but which also can be utilized to decorate and/or provide promotional information on the existing slat wall structure.

BACKGROUND ART

Many retail store establishments utilize conventional slat walls to carry products being displayed for sale. These slat walls are formed of horizontally oriented spaced boards or slats formed by providing horizontal slots in a pressboard, plywood or like material. A vertical slot is usually milled at the inner end of the space between the slats to form, with the space, a generally T-shaped opening between the slats. Conventional display hooks or shelves can then be mounted between the slats so that the wall can carry a multitude of products for retail display.

In addition to the initial expense of these slat walls, the major problem with them relates to their maintenance. They are not only often in need of frequent painting, but also, and more importantly, they are susceptible to chipping or cracking due to the frequent placement and removal or the display hooks and shelving. Such presents an unsightly problem which mere painting cannot resolve and eventually results in the need to replace the entire slat wall.

DISCLOSURE OF THE INVENTION

It is thus a primary object of the present invention to provide an inexpensive panel for resurfacing the slats of a slat wall.

It is another object of the present invention to provide a panel, as above, which is made of a sturdy, damage-proof plastic material which can be easily cleaned.

It is a further object of the present invention to provide a panel, as above, which can be easily attached to and removed from an existing slat wall.

It is yet another object of the present invention to provide a panel, as above, which can be provided on rolls and cut to length, as desired, or which can be provided already cut to a desired length.

It is an additional object of the present invention to provide a panel, as above, which can carry graphics, if desired, so that promotional or other material may be depicted on the slat wall.

These and other objects of the present invention, as well as the advantages thereof over existing prior art forms, which will become apparent from the description to follow, are accomplished by the means hereinafter described and claimed.

In general, a panel for covering a longitudinally extending slat board of a slat wall includes a longitudinally extending generally planar face having a lateral extent generally conforming to the lateral extent of the slat board. A first hook member is positioned generally at one lateral edge of the face to engage one lateral edge of the slat board. A second hook member is positioned generally at the other lateral edge of the face to engage the other lateral edge of the slat board.

In an alternative embodiment, opposed tabs are positioned generally at each lateral edge of the face to hold a sheet of material adjacent to the face.

Preferred exemplary panels for resurfacing a slat wall which incorporate the concepts of the present invention are shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
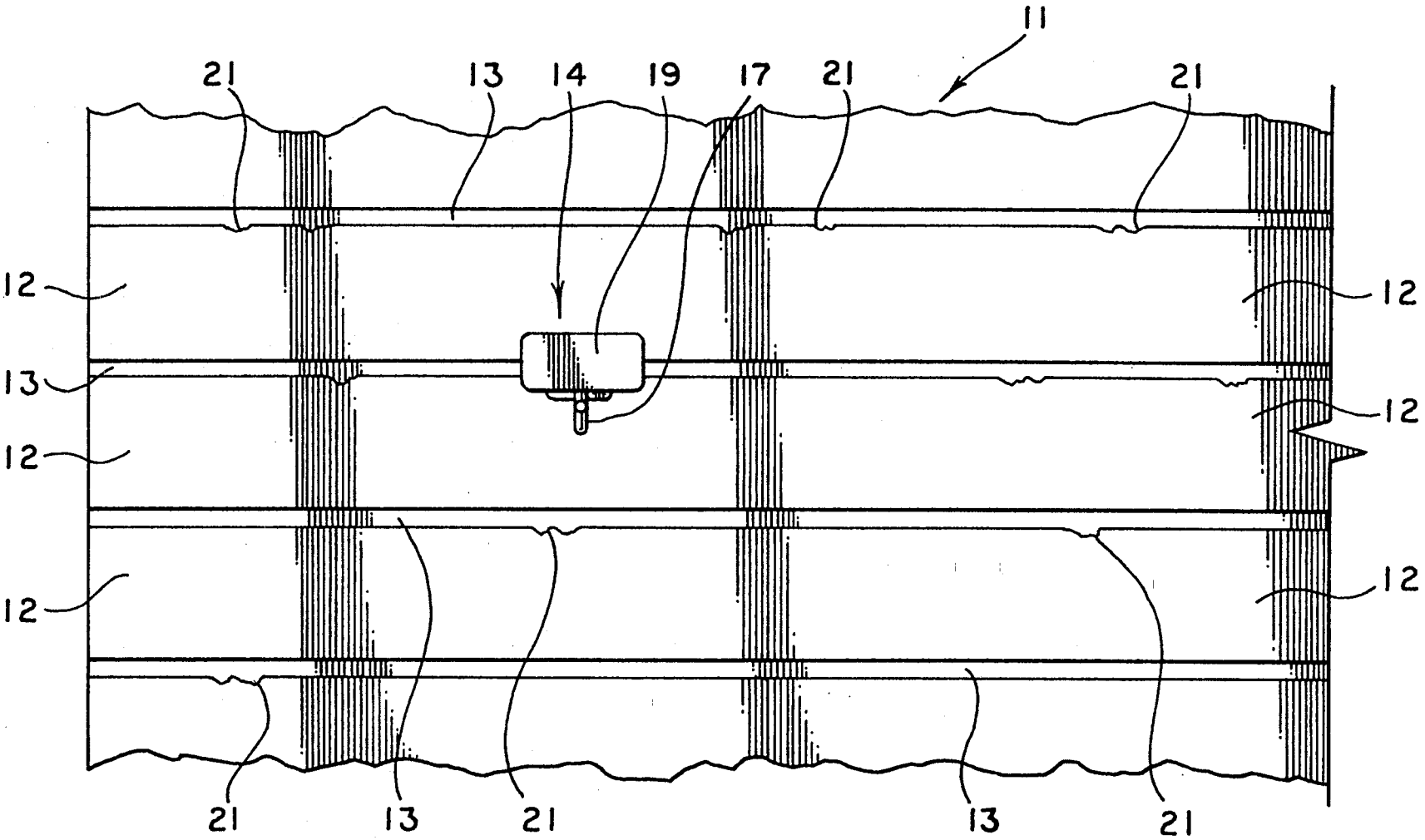
FIG. 1 is a fragmented elevational view of a portion of a conventional slat wall which forms the environment for the panel of the present invention.

A panel made in accordance with the present invention is indicated generally by the numeral 10 and is adapted for resurfacing a slat wall indicated generally by the numeral 11. Slat wall 11 is used primarily by retail establishments to display their wares and includes a plurality of spaced boards or slats 12 which are preferably formed by cutting a plurality of T-shaped slots 13 (FIG. 2) in a conventional pressboard or plywood sheet cut to the desired size for the display wall.

Figure 2:
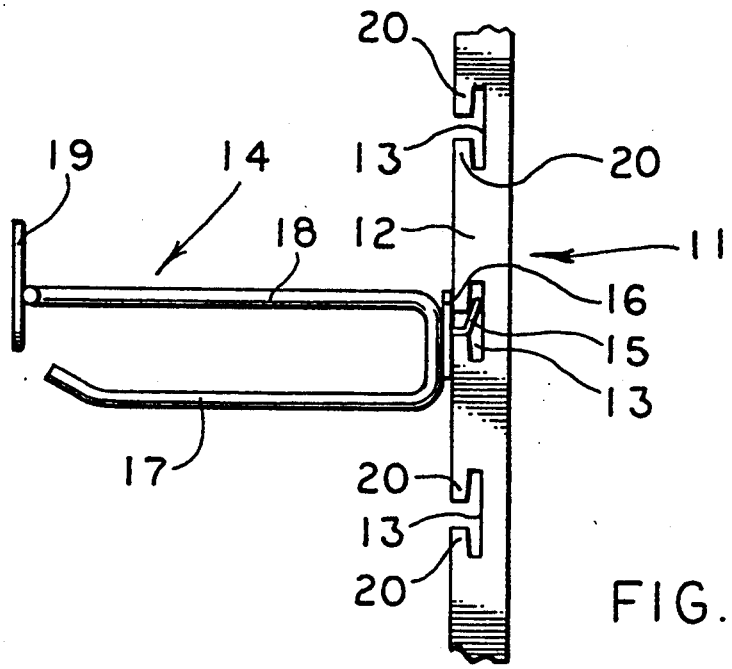
FIG. 2 is a fragmented side elevational view of the slat wall shown in FIG. 1.
Figure 3:
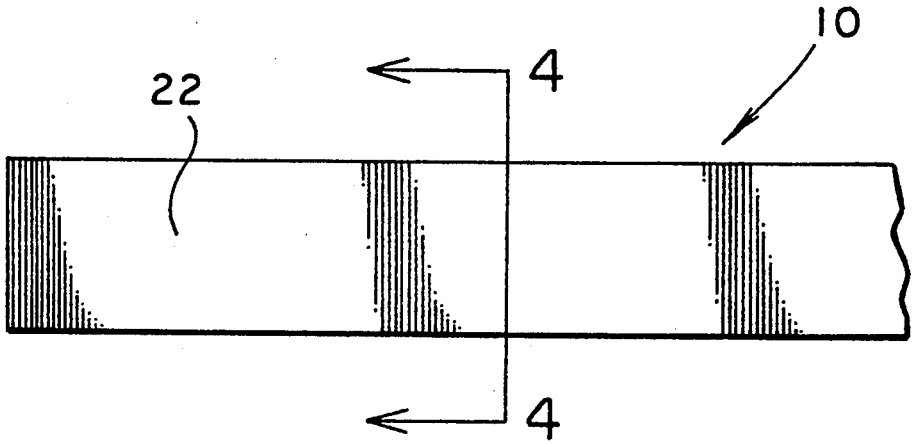
FIG. 3 is a fragmented front elevational view of a panel for resurfacing the slat wall made in accordance with the concepts of the present invention.

Slats 12 can carry a variety of product-supporting items such as shelves (not shown) or brackets, one such bracket being depicted in FIGS. 1 and 2, as representative, and being generally indicated by the numeral 14. The bracket 14 shown includes a hook member 15 which is engagable with a slot 13 to hold bracket 14 in a generally horizontal orientation as shown. The particular bracket 14 shown also has a bearing plate 16 resting against slat wall 11 and carrying a generally U-shaped member which includes a lower hooked arm 17 and an upper straight arm 18. Straight arm 18 is shown as having a generally vertically oriented face plate 19 affixed thereto. Products to be displayed on bracket 14 can be hung on hooked arm 17 and the price of the product, for example, can be displayed on face plate 19. Of course, as previously indicated, the bracket 14 shown is merely typical of a wide variety of bracket shapes or shelves which might be held by slat wall 11.

However, no matter what the configuration of the device being so held, it will always be engaged by slat wall 11 by a device similar to hook member 15 being received in slots 13. As such, with brackets 14 or like devices being continually put into, taken out of, or moved around on slat wall 11, particularly as product displays are changed, the lateral ends 20 of the face of slats 12 can be marred or chipped, as at 21 (FIG. 1), which eventually renders slat wall 11 unsightly. Merely painting wall 11, which may be frequently required in any event, does not hide chips 21 and thus eventually the wall must be replaced unless panel 10, now to be described, is employed.

Panel 10 can be made of any suitable plastic material, such as extruded polyvinylchloride, and can be precut in length to the length of the slat wall 11 on which it will be installed, or can be provided on rolls to be cut by the user at the site as desired. Panel 10 includes a longitudinally extending generally planar outer face 22, having a lateral extent or height corresponding to the height of slats 12. The lower end of face 22 is provided with a rearwardly directed hook member generally indicated by the numeral 23, and the upper end of face 22 is provided with a rearwardly directed hook member generally indicated by the numeral 24.

Lower hook member 23 includes a rearwardly directed generally horizontal surface 25, that is, extending orthogonally of face 22, and an upwardly directed surface 26 extending upwardly, preferably at an angle of about 120 degrees from surface 25 at the end thereof. Surface 26 is thus spaced from and opposes face 22 of panel 10.

Upper hook member 24 includes a rearwardly directed surface 27 which preferably extends somewhat upwardly from the top of face 22 at an angle of about 120 degrees from horizontal as it extends rearwardly from face 22. A surface 28 extends downwardly from the uppermost and rearwardmost end of surface 27 preferably at an angle of approximately 140 degrees from surface 27.

Figure 6:
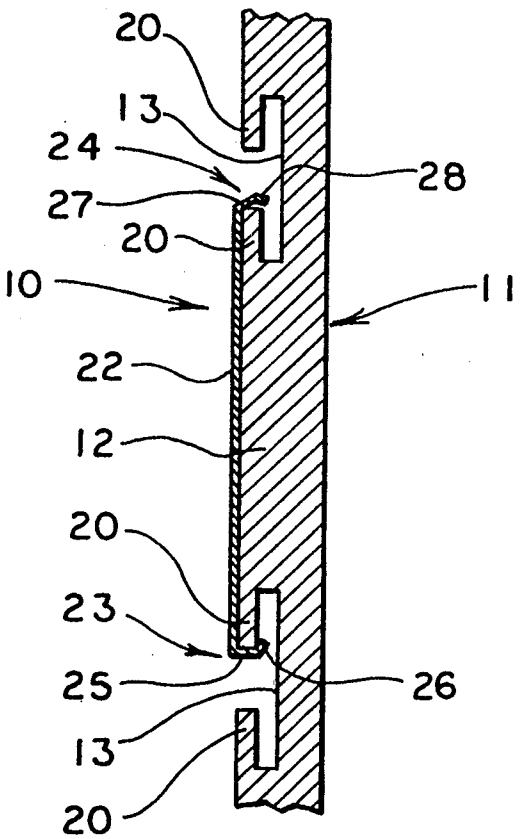
FIG. 6 is a fragmented sectional view showing a panel of the present invention installed on a slat wall.
Figure 7:
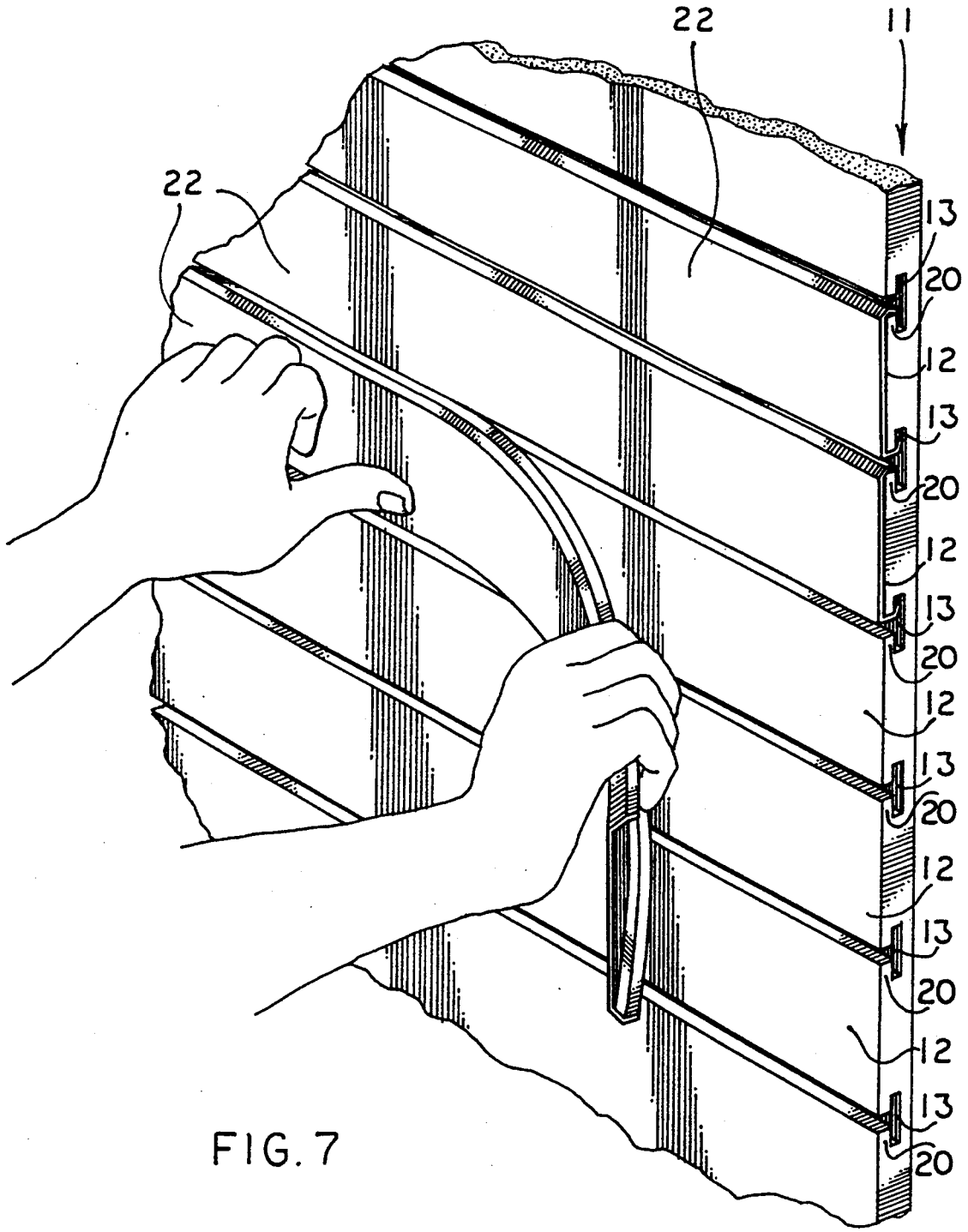
FIG. 7 is a graphic representation depicting the manner in which a panel made in accordance with the concepts of the present invention is installed on a slat wall.

Panels 10 can be readily installed on slat wall 11 as depicted in FIG. 7. Preferably lower hook member 23 at one longitudinal end of panel 10 and wall 11 is first placed into the slot 13 defining the lower end 20 of a slat 12 such that hook member 23 readily engages the lower end 20 of that slat 12 with horizontal surface 25 being parallel to and adjacent to flat bottom lateral end 20 of slat 12. Then upper hook member 24 can be snapped over the top lateral end 20 of that slat 12 and into the slot 13 defining that top end 20. Such action is assisted by the fact that surface 27 is angled, as opposed to horizontal, so that it readily slides over the upper lateral end 20 of slat 12. Then one need only run his hand longitudinally along that slat 12 pressing against panel 10 as shown in FIG. 7, and panel 10 will snap into place along the entire length of that slat 12. As installed, the manner in which hook members 23 and 24 engage the ends 20 of slat 12 is best shown in FIG. 6. In order to remove a panel 10 from a slat 12, one need only overcome the holding force of hook members 23 and 24 and effectively peel panel 10 from slat 12.

Panel 10 thus becomes a new surface for slats 12 hiding any chips, dents or scratches on the surface thereof. Moreover, if desired, face 22 can be painted or can be provided with graphics to advertise the product currently being displayed on wall 11. Of course, that product can be displayed in the same manner as if panel 10 were not there; that is, shelving or brackets, such as bracket 14, can be hooked into slots 13 in the normal fashion. In addition, if desired, panel 10 can be made of a clear plastic and a graphic strip of promotional, decorative, or other material may be positioned between face 22 and slat 12 so that it can be seen, but not touched, by the customer.

Figure 5:
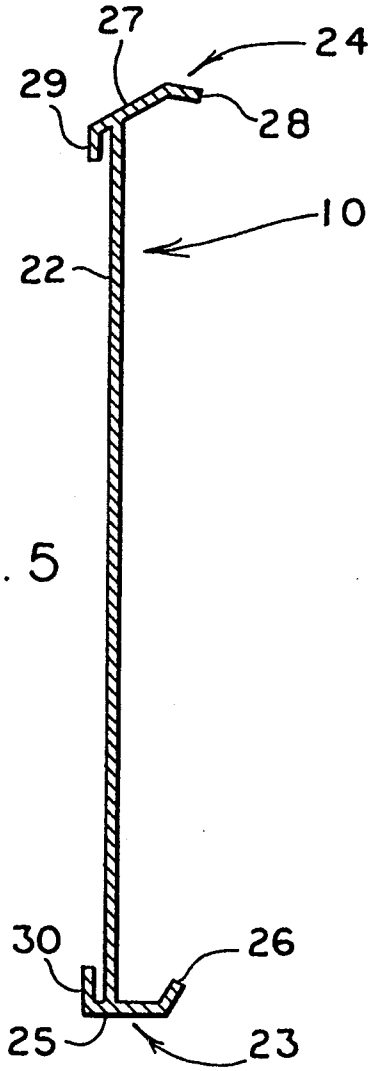
FIG. 5 is a sectional view similar to FIG. 4 and showing an alternative embodiment of a panel made in accordance with the present invention.
Figure 4:
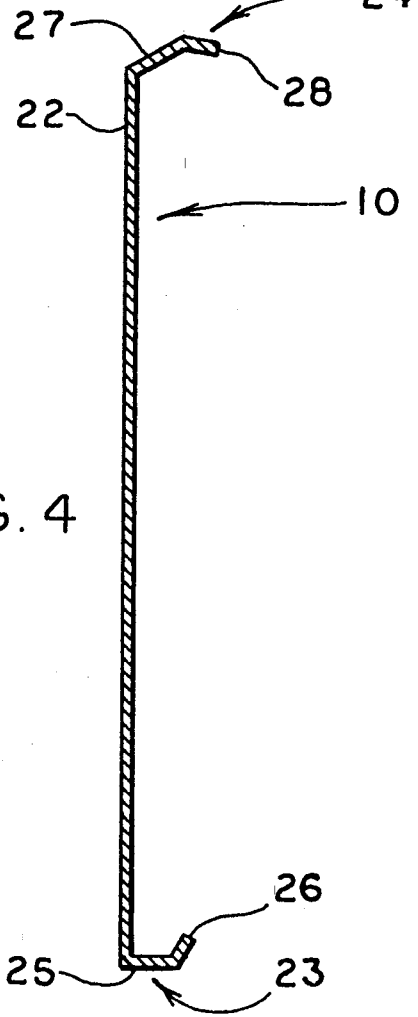
FIG. 4 is a sectional view taken substantially along line 4—4 of FIG. 3.

If the user would prefer to employ a more readily removable graphic strip, the alternative embodiment of panel 10, as depicted in FIG. 5, may be utilized. This embodiment is identical to that shown in FIG. 4 except that an upper tab 29 extends longitudinally along, and downwardly and spaced from the top of the front of face 22, and an opposed lower tab 30 extends longitudinally along, and upwardly and spaced from the bottom of the front of face 22. A graphic strip of promotional, decorative, or other material can then be longitudinally threaded between tabs 29 and 30 so that it is confined thereby against face 22.

It should be appreciated that a panel constructed as described herein accomplishes the objects of the present invention and otherwise substantially improves the slat wall resurfacing art.

I claim:

1. A panel for covering a longitudinally extending slat board of a slat wall comprising a longitudinally extending generally planar face having a lateral extent generally conforming to the lateral extent of the slat board, first hook means positioned generally at one lateral edge of said face to engage one lateral edge of the slat board, said first hook means including a first surface extending generally orthogonally away from said face and a second surface extending angularly from said first surface, and second hook means positioned generally at the other lateral edge of said face to engage the other lateral edge of the slat board, said second hook means including a first surface extending angularly from said face and a second surface extending angularly from said first surface.

2. A panel according to claim 1 further comprising opposed tab means positioned generally at said one lateral edge of said face and said other lateral edge of said face to hold a sheet of material adjacent to said face.

3. A panel according to claim 2 wherein said first and second hook means extend in one direction away from said face and toward the slat board and said tab means extend in the opposite direction away from said face and away from the slat board.

4. A panel according to claim 1 wherein the angle of said second surface of said first hook means to said first surface of said first hook means is approximately 120°.

5. A panel according to claim 5 wherein the angle of said first surface of said second hook means and said face is approximately 120° and the angle of said first surface of said second hook means and said second surface of said second hook means is approximately 140°.

6. A panel according to claim 1 made of a plastic material.

7. A panel for covering a longitudinally extending slat board of a slat wall having laterally spaced longitudinally extending grooves therein adapted to hold brackets for carrying products to be displayed, the panel comprising a longitudinally extending generally planar face having a lateral extent generally conforming to the lateral extent of the slat board, hook means extending away from said face in one direction to engage adjacent grooves of the slat board, and tab means extending away from said face in the opposite direction to hold a sheet of material against said face, the grooves still being able to receive the brackets adjacent to the sheet of material.

8. A panel according to claim 7 wherein said tab means includes a first tab positioned generally at one lateral edge of said face and an opposed second tab positioned generally at the other lateral edge of said face.

9. A panel according to claim 7 wherein said hook means includes a first hook positioned generally at one lateral edge of said face to engage one groove at one lateral edge of the slat board, and a second hook positioned generally at the other lateral edge of said face to engage an adjacent groove at the other lateral edge of the salt board.

10. A panel according to claim 9 wherein said first hook includes a first surface extending generally orthogonally away from said face and a second surface extending angularly from said first surface.

11. A panel according to claim 10 wherein the angle of said second surface to said first surface is approximately 120°.

12. A panel according to claim 10 wherein said second hook includes a first surface extending angularly from said face and a second surface extending angularly from said first surface.

13. A panel according to claim 10 wherein the angle of said first surface of said second hook and said face is approximately 120° and the angle of said first surface of said second hook and said second surface of said second hook is approximately 140°.

14. A panel according to claim 7 made of a plastic material.

15. A panel for converting a longitudinally extending slat board of a slat wall to a graphic display comprising a longitudinally extending generally planar face having a lateral extent generally conforming to the lateral extent of the slat board, said face being made of a clear plastic material, first hook means positioned generally at one lateral edge of said face to engage one lateral edge of the slat board, and second hook means positioned generally at the other lateral edge of said face to engage the other lateral edge of the slat board, such that when said first and second hook means engage the slat board a graphic strip of material may be positioned between said face and slat board.

* * * * *